United States Patent [19]

Watson

[11] 4,433,753

[45] Feb. 28, 1984

[54] WORK SUPPORTING APPARATUS

[76] Inventor: Marshall Watson, P.O. Box 474, Sublette, Kans. 67877

[21] Appl. No.: 407,033

[22] Filed: Aug. 11, 1982

[51] Int. Cl.[3] ..... B27B 21/00; A47B 37/00

[52] U.S. Cl. ..... 182/151; 182/178; 182/181; 182/224; 297/442

[58] Field of Search ..... 182/151, 181–185, 182/224, 178; 144/286 R, 286 A; 297/442

[56] References Cited

U.S. PATENT DOCUMENTS

| | | | |
|---|---|---|---|
| 1,419,647 | 6/1922 | Shepherdson | 297/442 |
| 1,645,336 | 10/1927 | McGlothern | 297/442 |
| 2,373,485 | 4/1945 | Long | 182/181 |
| 2,505,532 | 4/1950 | Ernst | 182/181 |
| 2,518,955 | 8/1950 | Stelzer | 297/442 |
| 2,911,265 | 11/1959 | Hannah | 182/181 |
| 3,035,660 | 5/1962 | Leon | 182/181 |
| 4,105,091 | 8/1978 | Mahan | 182/151 |

*Primary Examiner*—R. P. Machado

*Attorney, Agent, or Firm*—Kokjer, Kircher, Bradley, Wharton, Bowman & Johnson

[57] ABSTRACT

A wooden sawhorse device that can be quickly and easily assembled and disassembled without tools or fasteners. Tapered legs are each provided with slotted upper and lower edges and a contoured opening near the center of the leg. A pair of slotted sawhorse rails interfit with the slotted upper edges of the legs to rigidly connect the legs and provide a space for a 2'×6' board on top of the sawhorse. A slotted tool tray fits through the openings in the legs and interfits with the contoured edges of the openings to provide a rigid brace and a tool receiving surface. The sawhorses can be set up in pairs with scaffold rails extending between them to provide support for a flat work table. By stacking the sawhorses upon one another and installing the scaffold rails between the uppermost sawhorse rails, multiple level scaffolding can be formed. The sawhorse rails can be replaced by miter box rails which are specially constructed to receive and support a power miter box.

10 Claims, 4 Drawing Figures

WORK SUPPORTING APPARATUS

BACKGROUND AND SUMMARY OF THE INVENTION

This invention relates to a sawhorse device that can be used either alone or in conjunction with additional units to form a work table or multi-level scaffolding.

It is the primary goal of the invention to provide a versatile device that is useful to carpenters, contractors, painters, paper hangers, mechanics, do-it-yourself homeowners and others having need for a sawhorse, a work table, or elevated scaffolding.

More specifically, it is an important object of the invention to provide a work supporting device that can be set up to function as a sawhorse, can be arranged side by side with an identical unit to support a work surface, and can be stacked with any desired number of additional units to function as scaffolding.

Another important object of the invention is to provide a device of the character described that can be quickly and easily assembled for use and disassembled for convenient storage in a compact form. It is significant in this respect that there is no need for tools or nails, bolts, screws, brackets or other mechanical fasteners. Also, the components can be stored when disassembled by hanging them together on a wall or the like.

Still another object of the invention is to provide a device of the character described that is stable and sturdy when assembled. The configuration of the unit when set up gives it a rigid construction that prevents inadvertent tipping or other instability.

A further object of the invention is to provide a device of the character described which is strong enough to handle heavy loads and yet portable in both assembled and disassembled form.

An additional object of the invention is to provide, in a device of the character described, a conveniently located tool tray for holding tools and other articles at a readily accessible position.

Yet another object of the invention is to provide a device of the character described which is adapted to accommodate a power miter box of any standard manufacture.

A still further object of the invention is to provide a device of the character described which is simple and economical to construct and which is formed from attractive and high quality wood.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in the various views.

Figure 1:
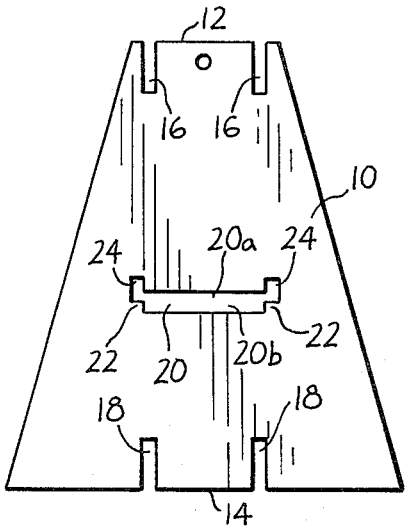
FIG. 1 is a plan view showing the components of a sawhorse device constructed according to the present invention.
Figure 2:
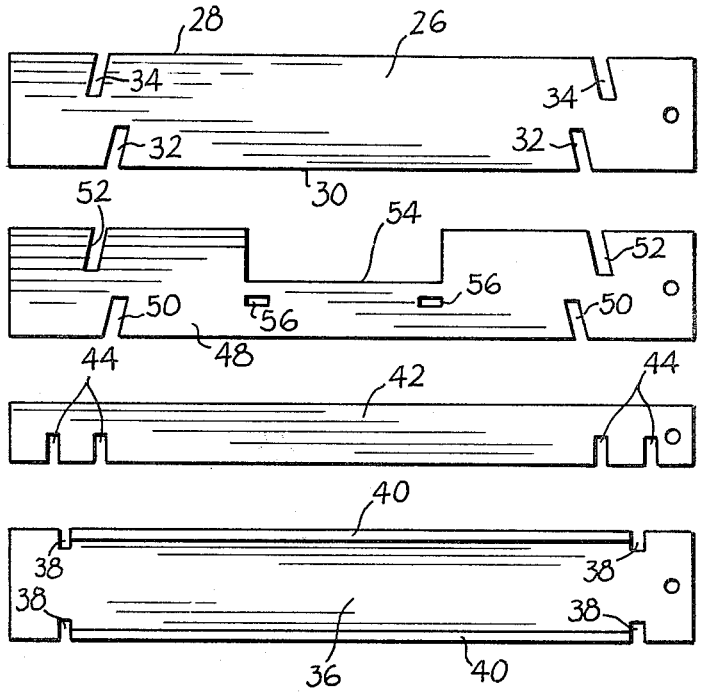
FIG. 2 is a perspective view of the sawhorse device in assembled form.
Figure 2:
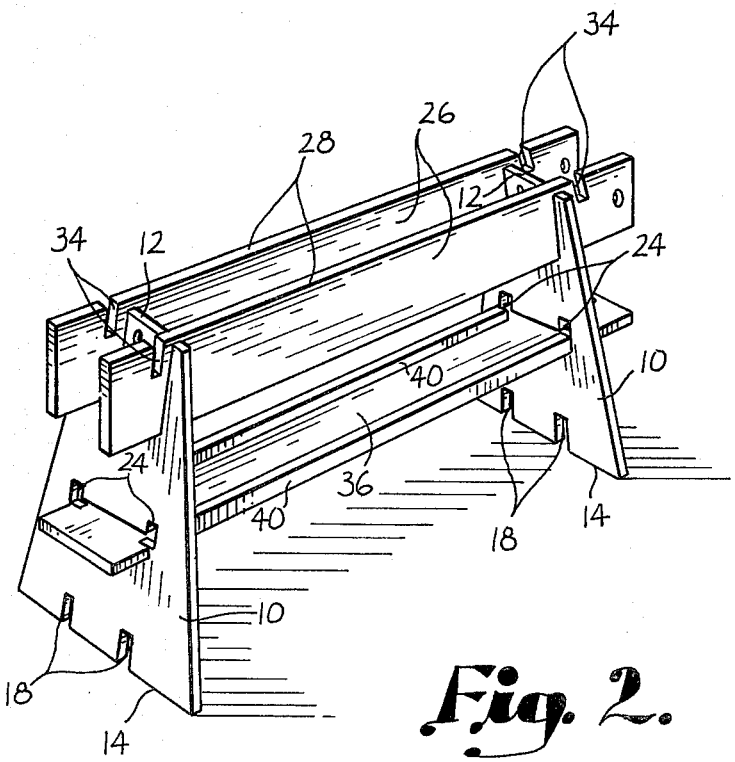

Referring now to the drawings in more detail and initially to FIGS. 1 and 2, a sawhorse device constructed in accordance with the present invention includes a pair of identical legs 10. Each leg 10 is a solid piece of plywood or the like having parallel upper and lower edges 12 and 14. The lower edge 14 rests on a floor or other support surface when the device is assembled. Each leg is gradually tapered from bottom to top such that the base or lower edge 14 is considerably broader than the upper edge 12. A pair of spaced apart slots 16 are formed in the upper edge 12 of each leg, and another pair of equally spaced slots 18 are formed in the lower edge 14 of each leg.

Each leg 10 is provided approximately midway between the upper and lower edges with a contoured opening 20. The opening has an upper portion **20*a* and a lower portion 20*b* which is immediately below and somewhat shorter than the upper portion such that a pair of ears 22 are provided beyond the ends of the lower opening portion 20*b* and below the ends of the upper opening portion 20*a*. Above the ears 22, the opening 20 has slot portions 24 which extend upwardly from the opposite ends of the upper portion 20*a*** of the opening.

The sawhorse also includes a pair of rails 26 which extend between the upper ends of the two legs 10, as shown in FIG. 2. Each rail 26 is formed from a piece of plywood or similar material and has upper and lower edges 28 and 30 which are parallel to one another and to the longitudinal axis of the rail. A pair of angled slots 32 are formed in the lower edge 30 of each rail slightly inwardly of its opposite ends. Each slot 32 is offset from a perpendicular relationship with edge 30 and angles inwardly somewhat from bottom to top. The slots 32 are sized and shaped to mate with the slots 16 in the upper edges of legs 10, and the thickness of each leg 10 and rail 26 and the width of each slot are such that the slots 16 and 34 are firmly interlocked when mated together in the manner shown in FIG. 2.

The upper edge 28 of each rail is also provided with a pair of angled slots 34. The slots 34 are located inwardly from the opposite ends of rail 26 and are located closer to the ends of the rail than the lower set of slots 32. Each slot 34 is offset from a perpendicular relationship with the longitudinal axis of the rail and angles outwardly somewhat from top to bottom. Each slot 34 is parallel to the opposing slot 32 on the lower edge of the rail.

A tool tray 36 functions as a brace to make the sawhorse rigid and stable when assembled. The tool tray is cut from a piece of plywood or the like and is provided on each of its side edges with a pair of opposed slots 38 located near the opposite ends of the tool tray. The slots 38 are sized and shaped to closely receive the ears 22 which border the central opening 20 in each leg 10. Each side edge of the tool tray is provided with an upstanding lip 40 which extends upwardly along the edge of the tool tray between slots 38. Lips 40 prevent tools which are positioned on the upper surface of the tool tray from sliding off. The lips 40 fit in slots 24 when the body of the tool tray 36 is fit in the upper portion **20*a* of opening 20**, as will be explained more fully.

FIG. 2 illustrates the sawhorse device in its assembled form. Assembly is accomplished by interlocking the slots 32 in the lower edges of rails 26 with the slots 16 in the upper edges of legs 10. The fit between the sets of slots 16 and 32 spaces legs 10 apart from one another and spaces rails 26 apart and parallel to one another in extension between the top ends of the legs. The angled orientation of slots 32 provides stability in the device and spaces the broad lower edges 14 of the legs farther apart than the upper edges 12 such that the legs angle inwardly from bottom to top.

The tool tray 36 is installed by positioning one end in the upper portion 20*a* of the opening 20 in one of the legs and sliding the tool tray toward the opposite leg. The lips 40 fit within slots 24, and the body of the tool tray fits within opening portion 20*a* with its side edge riding on top of the ears 22. When the tool tray has been properly positioned with the slots 38 near its opposite ends located directly above the ears 22, the tool tray drops down into the lower opening portion 20*b* and slots 38 closely receive the ears 22. The width of the tool tray 36 between the bases of the slots 38 is substantially equal to the width of the lower opening portion 20*b*, and the ears 22 thus fit closely in slots 38 to maintain the tool tray rigidly in place in extension between intermediate portions of the two legs 10. The upper surface of the tool tray is in a horizontal orientation to receive tools and other articles.

When the sawhorse device is fully assembled as shown in FIG. 2, the upper edges 28 of the rails are located approximately 1 inch above the upper edges 12 of the legs, and the rails are spaced apart approximately $5\frac{1}{2}$ inches. Accordingly, a standard $2\times6$ board (not shown) can be fitted on top of the legs and between rails 26 with the board projecting approximately $\frac{1}{2}$ inch above the upper edges of the rails. Any normal operation that can be carried out on a conventional sawhorse can then be carried out on the board which is installed between the rails.

Figure 4:
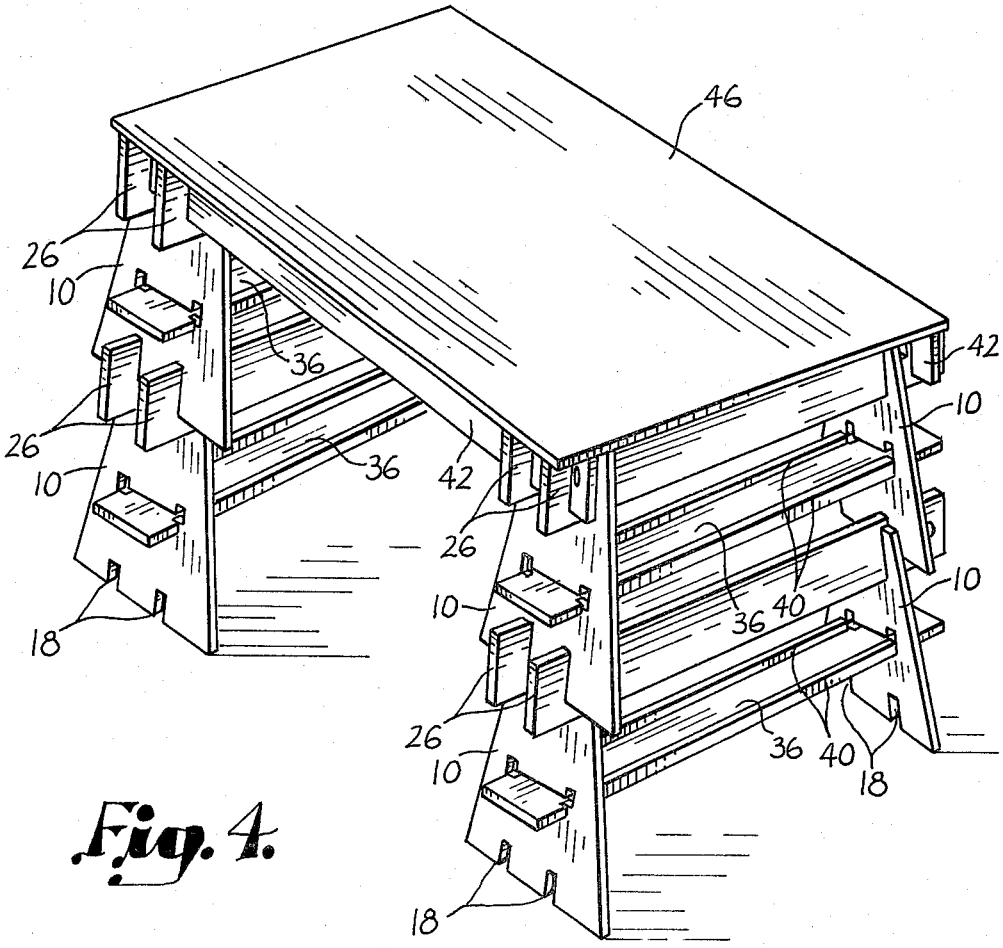
FIG. 4 is a perspective view showing a plurality of units stacked in two side by side groups to provide scaffolding.

FIG. 4 illustrates a plurality of the sawhorse devices stacked one on top of the other in two spaced apart, side by side groups to serve as two level scaffolding. The lower edge 14 of each leg in the two bottom units rests on the floor or another supporting surface. The upper unit in each group has the slots 18 in the lower edge of each leg interlocked with the slots 34 formed in the upper edges of the underlying rails 26. In this manner, one unit can be stacked on top of another and supported thereon in a rigid and stable position. The angled orientation of slots 34 accommodates the incline of the legs 10 in the overlying unit. At the same time, the location of slots 34 outwardly of slots 32 assures that the lower edge of each leg is directly above the lower edge of the underlying leg, and that the upper edge of each leg is directly above the upper edge of the underlying leg, thereby centering the elevated units for further stability.

The two groups of stacked units are rigidly connected by a pair of scaffold bars or rails 42 which are best illustrated in FIG. 1. Each scaffold rail 42 has parallel upper and lower edges and a pair of spaced apart slots 44 formed near each end of the lower edge. The slots 44 are located to mate with the slots 34 in the upper edges of the sawhorse rails 26.

When the scaffold rails are installed in the manner shown in FIG. 4, the close fit between slots 44 and 34 provides a rigid connection between the two stacks of sawhorse devices which form the scaffolding. The upper edges of the scaffold rails 42 are spaced apart and parallel to one another and are perpendicular to the upper edges of the sawhorse rails 26. The upper edges of the scaffold rails 42 are in the same horizontal plan as the upper edges 28 of the sawhorse rails 26 to cooperate therewith in forming a rigid rectangular frame for supporting a rectangular platform 46. The platform 46 can be a sheet of plywood or any other suitable material, and it rests in a stable horizontal position on top of the framework provided by the scaffolding arrangement.

It is to be understood that virtually any desired number of units can be stacked one upon another to provide the desired height of the scaffolding. Also, the platform can be positioned on a single pair of spaced apart units to provide a work table (or single level scaffolding). Preferably, the sawhorse rails 26 are approximately 4 feet long and the scaffold rails 42 are approximately 8 feet long in order to accommodate a standard $4\times8$ sheet of plywood as the platform.

Figure 3:
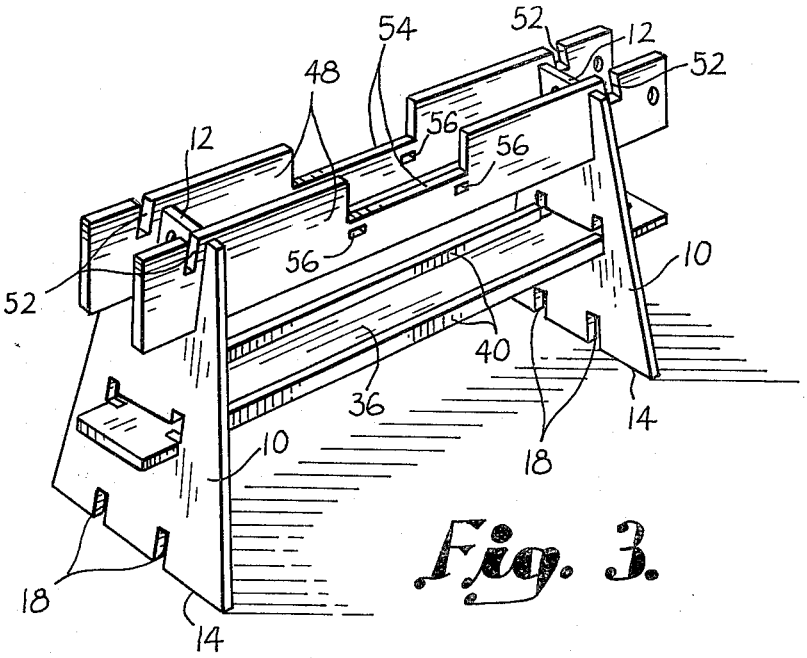
FIG. 3 is a perspective view showing the sawhorse device set up with miter box rails in order to receive a power miter box.

FIG. 3 illustrates the device assembled to accommodate a power miter box. The assembly of FIG. 3 is identical to that of FIG. 2, except that the sawhorse rails 26 are replaced by a pair of specially constructed miter box rails 48. As best shown in FIG. 1, the miter box rails 48 are identical in many respects with the sawhorse rails 26. The lower and upper edges of each miter box rail 48 are provided with slots 50 and 52 which are identical to slots 32 and 34. The difference between the miter box rails and the sawhorse rails is that each migher box rail is provided with a rectangular cutout 54 midway along the length of its upper edge and with a pair of spaced apart slots 56 beneath the cutout 54.

When the device is assembled to accommodate a miter box (see FIG. 3), the cutouts 54 in the two miter box rails are aligned, and the cutouts are sized to receive the body of a power miter box (not shown) with the miter box resting on the edges underlying the cutouts. A $2\times6$ board placed between the miter box rails is flush with the table of the miter box, and the miter box includes on its base bars or lugs which fit through the slots 56 in order to secure the miter box in a stationary position on the device. It is to be understood that the size and configuration of the cutouts 54 and the size and location of the slots 56 can be varied to accommodate different miter box styles.

It is thus evident that the device can be used as a sawhorse (FIG. 2), can be set up to accommodate a power miter box (FIG. 3), can be set up with one additional unit to provide a work table or single level scaffolding, and can be set up with additional units as multiple level scaffolding (FIG. 4). In all cases, assembly and disassembly can be quickly and easily carried out without the need for tools or for any type of mechanical connectors or fasteners. The slotted construction of the components assures that they fit together tightly to provide a rigid construction which exhibits the necessary strength and stability. The inclined orientation of the legs 10, together with the tapered configuration of the legs, assures that the necessary stability is achieved, even when multiple units are stacked one upon the other to provide multiple level scaffolding. The device is strong enough to handle all loads normally encountered and has been successfully tested with loads up to 2000 pounds.

Preferably, all of the components are made of high quality $\frac{3}{4}$ inch plywood which is attractively stained and finished or otherwise treated to provide protection from weather. Each of the components can be provided with a hole as shown in the drawings, so that all of the components can be hung on a rope or peg when disassembled. In the disassembled condition, the device occupies only minimal space since the components can be arranged flatly against one another. A rope or other handle device (not shown) can be threaded through the holes in the two legs of each unit to permit the assembled device to be easily carried from one location to another.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. Work supporting apparatus having a unit comprising:

a pair of legs each having a substantially solid body portion tapering from bottom to top, each leg having a lower edge for engagement with a support surface and an upper edge presenting a pair of spaced apart slots therein;

a pair of elongated rails each having a longitudinal axis and upper and lower edges extending generally parallel to said longitudinal axis;

a pair of slots in the lower edge of each rail near opposite ends thereof sized to detachably interlock with the slots in the upper edges of said legs in a manner to connect the legs and rails together with the legs spaced apart and the rails spaced apart in extension between the legs to provide a space between the rails and above the legs for receiving a work supporting member in an assembled condition of the unit;

a rigid brace having opposite side edges and a pair of slots near opposite ends of each side edge, said brace presenting an upper surface adapted to receive and hold objects thereon and upstanding lips on each side edge to maintain objects on said upper surface; and an opening in the body portion of each leg at a location intermediate said upper and lower edges of the leg, each opening having a configuration to receive an end portion of said brace and to detachably interlock with the slots thereof in a manner to rigidly connect said brace in extension between said legs with said upper surface in a substantially horizontal orientation to receive and hold objects in the assembled condition of the unit, each opening further including a pair of slot portions sized and located to receive said lips when the brace is extended through the opening.

2. The invention of claim 1, wherein the slots in the lower edge of each rail are offset from a perpendicular relationship with the longitudinal axis of the rail at an orientation to space the lower edges of the legs more distantly than the upper edges of the legs when the slots of the rails are interlocked with the slots in the upper edges of the legs.

3. The invention of claim 1, including:

a cutout in the upper edge of each rail located substantially midway along the length thereof, said cutouts of the rails being aligned when the slots of the rails are interlocked with the slots of the legs and said cutouts being shaped to receive a miter box therein; and means on said rails for securing the miter box in a stationary position in said cutouts.

4. The invention of claim 1, including:

a second one of said units adapted to be spaced to one side of the first mentioned unit in the assembled condition;

a pair of slots in the upper edge of each rail near opposite ends there of; and a pair of elongate scaffolding bars each having upper and lower edges and a pair of spaced apart slots near each end of the lower edge, said slots in the scaffolding bars being arranged to detachably interlock with the slots in the upper edges of the rails to connect the scaffolding bars in extension between the rails of the first and second units, said scaffolding bars and rails cooperating to form a rigid frame of generally rectangular configuration for receiving and supporting a table surface on the upper edges of the rails and scaffolding bars.

5. The invention of claim 4, wherein the slots in the upper edges of the rails are located outwardly of the slots in the lower edges of the rails.

6. Scaffolding apparatus having multiple units each comprising:

a pair of legs each having a substantially solid body portion and upper and lower edges each presenting a pair of spaced apart slots;

a pair of elongate rails each having a longitudinal axis and upper and lower edges extending substantially parallel to said longitudinal axis;

a pair of slots in the lower edge of each rail adapted to be detachably interlocked with the slots in the upper edges of said legs to connect the rails with the legs in extension between the legs;

a rigid brace;

means for detachably securing said brace in extension between portions of the legs intermediate the upper and lower edges thereof;

a pair of slots in the upper edge of each rail adapted to be detachably interlocked with the slots in the lower edge of one leg of another unit, whereby the units can be arranged in two side by side groups each including a plurality of units stacked one on top of another; and said apparatus further comprising a pair of scaffolding bars each having upper and lower edges and a pair of spaced apart slots near each end of the lower edge, said slots in the scaffolding bars being adapted to be detachably interlocked with the slots in the upper edges of the rails of the uppermost units in each group to connect the scaffolding bars in extension between the rails of the uppermost rails to cooperate therewith in providing a rigid frame of generally rectangular configuration for receiving and supporting a platform on the upper edges of the scaffolding bars and rails of the uppermost units.

7. The invention of claim 6, wherein for each unit:

the slots in the lower edge of each rail are offset from a perpendicular relationship with the longitudinal axis of the rail at an orientation to space the lower edges of the legs more distantly than the upper edges; and the slots in the upper edge of each rail are spaced outwardly of the slots in the lower edge of the rail and are located and oriented such that the lower edge of each leg is located substantially directly beneath the lower edge of the overlying leg and the upper edge of each leg is located substantially directly beneath the upper edge of the overlying leg when the units are stacked one on top of another.

8. The invention of claim 6, wherein said detachable securing means for each unit includes:

an opening in the body portion of each leg at a location intermediate said upper and lower edges of the leg, each opening being sized to receive an end portion of the brace therein; and slot means on opposite end portions of said brace for interlocking with said openings in a manner to detachablt connect said brace inextension between the legs.

9. Work supporting apparatus having a unit comprising:

a pair of legs each having a substantially solid body portion tapering from bottom to top, each leg having a lower edge for engagement with a support surface and an upper edge presenting a pair of spaced apart slots therein;

a pair of elongate rails each having a longitudinal axis and upper and lower edges extending generally parallel to said longitudinal axis;

a pair of slots in the lower edge of each rail near opposite ends thereof sized to detachably interlock with the slots in the upper edges of said legs in a manner to connect the legs and rails together with the legs spaced apart and the rails spaced apart in extension between the legs to provide a space between the rails and above the legs for receiving a work supporting member in an assembled condition of the unit;

a rigid brace having opposite side edges and a pair of slots near opposite ends of each side edge, said brace presenting an upper surface adapted to receive and hold objects thereon;

an opening in the body portion of each leg at a location intermediate said upper and lower edges of the leg, each opening having a configuration to receive an end portion of said brace and to detachably interlock with the slots thereof in a manner to rigidly connect said brace in extension between said legs with said upper surface in a substantially horizontal orientation to receive and hold objects in the assembled condition of the unit;

a cutout in the upper edge of each rail located substantially midway along the length thereof, said cutouts of the rails being aligned when the slots of the rails are interlocked with the slots of the legs and said cutouts being shaped to receive a miter box therein; and means on said rails for securing the miter box in a stationary position in said cutouts.

10. Work supporting apparatus having first and second units each comprising:

a pair of legs each having a substantially solid body portion tapering from bottom to top, each leg having a lower edge for engagement with a support surface and an upper edge presenting a pair of spaced apart slots therein;

a pair of elongate rails each having a longitudinal axis and upper and lower edges extending generally parallel to said longitudinal axis;

a pair of slots in the lower edge of each rail near opposite ends thereof sized to detachably interlock with the slots in the upper edges of said legs in a manner to connect the legs and rails together with the legs spaced apart and the rails spaced apart in extension between the legs to provide a space between the rails and above the legs for receiving a work supporting member in an assembled condition of the unit;

a rigid brace having opposite side edges and a pair of slots near opposite ends of each side edge, said brace presenting an upper surface adapted to receive and hold objects thereon;

an opening in the body portion of each leg at a location intermediate said upper and lower edges of the leg, each opening having a configuration to receive an end portion of said brace and to detachably interlock with the slots thereof in a manner to rigidly connect said brace in extension between said legs with said upper surface in a substantially horizontal orientation to receive and hold objects in the assembled condition of the unit;

said first and second units being adapted to be spaced apart from one another in a generally side by side arrangement in the assembled condition and said apparatus further comprising a pair of slots in the upper edge of each rail near opposite ends there of; and a pair of elongate scaffolding bars each having upper and lower edges and a pair of spaced apart slots near each end of the lower edge, said slots in the scaffolding bars being arranged to detachably interlock with the slots in the upper edges of the rails to connect the scaffolding bars in extension between the rails of the first and second units, said scaffolding bars and rails cooperating to form a rigid frame of generally rectangular configuration for receiving and supporting a table surface on the upper edges of the rails and scaffolding bars.

* * * * *